United States Patent [19]

Saito et al.

[11] 4,445,933

[45] May 1, 1984

[54] METHOD OF REFINING MOLTEN STEEL

[75] Inventors: Tetsuya Saito; Hiroshi Mori, both of Aichi, Japan

[73] Assignee: Daido Tokushuko Kabushiki Kaisha, Aichi, Japan

[21] Appl. No.: 445,515

[22] Filed: Nov. 30, 1982

[51] Int. Cl.[3] ..... C21C 5/34

[52] U.S. Cl. ..... 75/59; 75/60

[58] Field of Search ..... 75/59, 60

[56] References Cited

U.S. PATENT DOCUMENTS

| | | | |
|---|---|---|---|
| 3,169,058 | 2/1965 | Nelson | 75/59 |
| 3,854,932 | 12/1974 | Bishop | 75/60 |
| 3,971,655 | 7/1976 | Takashima | 75/60 |
| 4,160,664 | 7/1979 | Maruhashi | 75/60 |
| 4,174,212 | 11/1979 | Bauer | 75/60 |
| 4,208,206 | 6/1980 | Death | 75/60 |
| 4,325,730 | 4/1982 | Schleimer | 75/60 |

*Primary Examiner*—Peter D. Rosenberg

*Attorney, Agent, or Firm*—Armstrong, Nikaido, Marmelstein & Kubovcik

[57] ABSTRACT

An improved method of refining molten steel is disclosed. Inert gas such as argon is injected into the molten steel in a refining vessel through tuyeres at the bottom and blown through a lance from the top of the vessel. The method is particularly useful for producing steel of very low oxygen content.

4 Claims, 2 Drawing Figures

METHOD OF REFINING MOLTEN STEEL

BACKGROUND OF INVENTION

1. Field of the Invention

The present invention concerns an improved method of refining molten steel. The method is suitable for producing a steel of very low oxygen content.

2. State of the Art

It is known to blow inert gas to molten steel in a vessel through tuyeres at the bottom of the vessel or through an immersed lance to stirr the molten steel for increased refining effect. Particularly, the technology using both oxygen gas and argon gas in decarburization period is widely practised as "AOD Refining".

In continuous casting of steel, the most significant problem limiting possible length of the continuous operation is plugging of an immersed nozzle through which the molten steel in a tandish is pourred into a mold. Through seeking cause of the plugging, it has been found that magnesium content in the molten steel is so important that Mg should be controlled to 5 ppm or less to enable troubleless continuous casting.

Also, the oxygen content which determines amount of oxide inclusions is important matter in various steels. In specific steels which should have good fatigue strength or rolling fatigue strength, oxygen must not be more than 0.001%.

In case where both oxygen content and sulfur content of, for example, a chromium-containing steel used as a header material should be extremely low, the refining with blowing inert gas to realize the above mentioned low magnesium content will comprise the following steps:

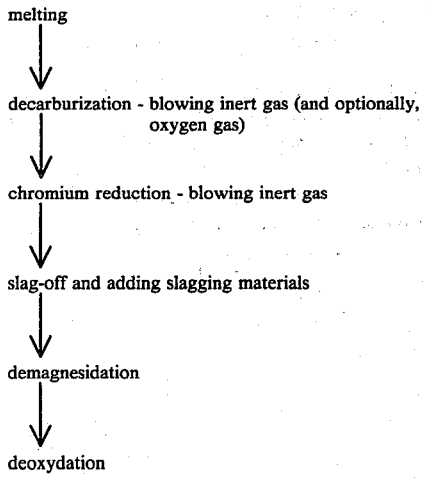

In the above process, it is necessary to keep basicity of slag (defined as: $V=(CaO+MgO)/(SiO_2+Al_2O_3)$) during chromium-reducing period to a level as high as 1.8 or more for the purpose of thorough desulfurization to achieve S: 0.002% or less.

On the other hand, during demagnesidation period, the basicity of slag must be maintained at $V=1.5$ to 1.7. This is because it is possible to make compromise only in this range between advantage at a higher slag basicity for decreasing oxygen content in the molten steel (e.g., to 80 ppm or less) and preferable lower basicity for controlling the magnesium content (say, up to 4 ppm).

As readily understood by those skilled in the art, the above very narrow gratitude in the slag basicity during the demagnesidation period causes serious difficulty to commercial practice of the refining. Also, refractory material of the vessel will be damaged by the slag having so high basicity as $V=1.6$ or more, and necessitates frequent repairing.

In the circumstances, there has been demand for the technology which produces the steel of low magnesium content enabling continuous casting of many charges, and, at the same time, of low oxygen content using slag of such a lower basicity that will not damage the vessel refractories.

SUMMARY OF THE INVENTION

An object of the present invention is to satisfy the above demand and to provide an improved method of refining molten steel, which is characterized by injecting inert gas into molten steel in a refining vessel through the bottom of the vessel, and at the same time blowing inert gas from the top of the vessel so that atmosphere in the vessel may be kept almost completely inert during the refining, thus produces molten steel of very low oxygen content.

The idea of blowing the inert gas from the top was proposed on finding the fact that, in the conventional refining which uses only injection of inert gas through the bottom, the atmosphere in the vessel was analized to have, contrary to our assumption, an oxygen partial pressure of no substantial difference from that of air.

DRAWINGS

DETAILED EXPLANATION OF PREFERRED EMBODIMENTS

Figure 1:
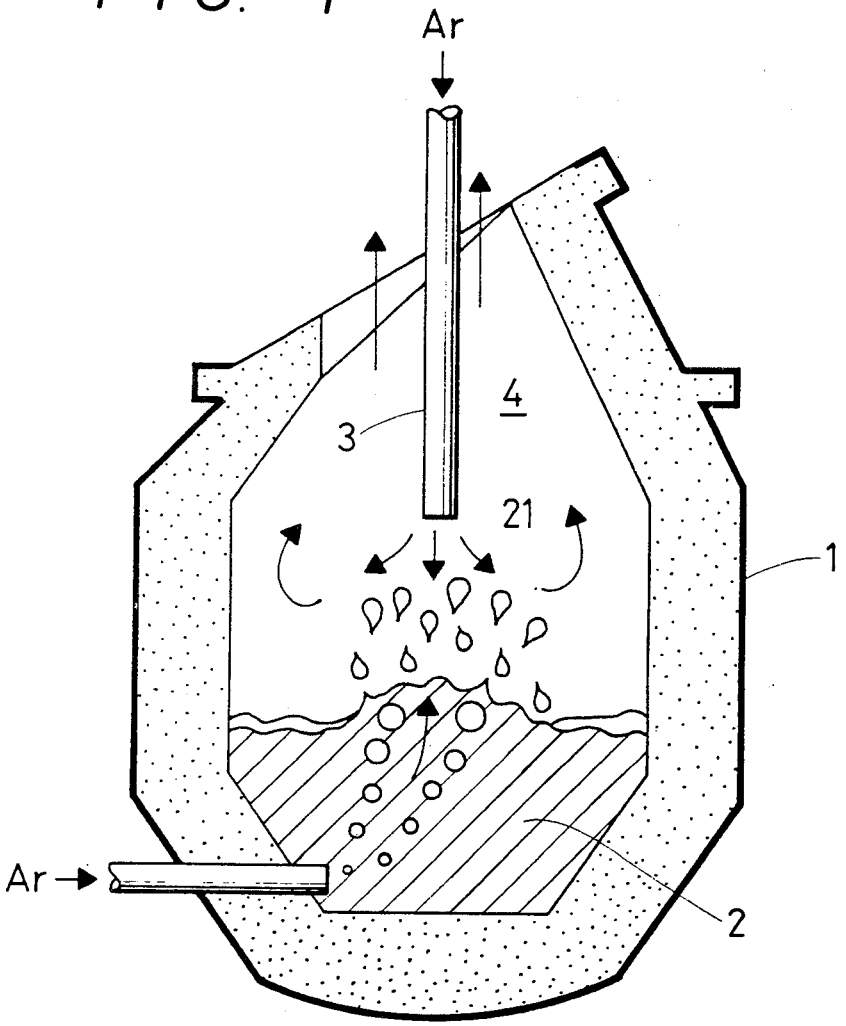
FIG. 1 is a sectional view of the refining vessel in which the present method is being carried out.

The present method of refining is practised as shown in FIG. 1.

Injection of inert gas through the bottom of vessel 1 into molten steel 2 causes vigorous stirring of the molten steel, and the molten steel in the form of many drops 21 repeatedly goes up and comes down. By blowing inert gas through blowing lance 3, atmosphere 4 in vessel 1 is almost completely replaced with the inert gas. As a result, oxygen partial pressure in the vessel becomes substantially zero, and the surfaces of the sloshing molten steel and the fluidizing drops thereof are always exposed to the fresh inert gas. Thus, oxygen in the molten steel is released mainly in the form of CO from the surfaces of the molten steel and the drops thereof into the atmosphere and is carried away by the inert gas to achieve thorough deoxidation.

As the inert gas, argon is of course typical. In some cases, also nitrogen may be used. The quantity of blowing may be preferably equal to or a little less than the quantity of injection.

Time of the blowing may be chosen optionally at each stage of refining to get the merits explained in the examples below.

The inert gas injected through the bottom of the vessel and the inert gas blown from the top join and flow together upwardly to leave the vessel. It is experienced that, depending upon the shape of mouth of the vessel, environmental air may be inhaled in the vessel to change place with the inert gas. If air invades into the vessel, the atmosphere in the vessel cannot be perfectly inert, and therefore, air-invasion should be prevented. For this purpose, it is effective to choose a mouth shape with which less inhalation of air occurs, or to use a suitable hood on the vessel.

The present method of refining molten steel is applicable to various steels, and particularly useful for refining Cr-based stainless steels. In cases where the method is applied to Cr-containing steels, there is obtained advantage of decreased $Cr_2O_3$ content in the slag during chromium-reducing period, and as the result, improved chromium recovery as seen in the following examples.

EXAMPLE 1

Iron scrap and chromium-containing material were melted in an electric furnace and the molten metal was pourred into a refining vessel. Argon gas and oxygen gas were injected through tuyeres at the bottom of the vessel. Rate of injecting the gases gradually decreased from 20 $Nm^3$/min to 16 $Nm^3$/min.

Then, in the chromium-reducing period, only argon gas is used and injected through the bottom in the rate of 8 $Nm^3$/min and blown from the top through a lance also in the rate of 8 $Nm^3$/min for 6 minutes.

By adjusting slag composition, basicity thereof was changed in the range of V=1.2–1.9, and the relation between the oxygen content in the molten steel after the refining and the slag basicity was recorded.

For the purpose of comparison, measurement was made on the oxygen content of the molten steel which was produced without argon blowing.

Figure 2:
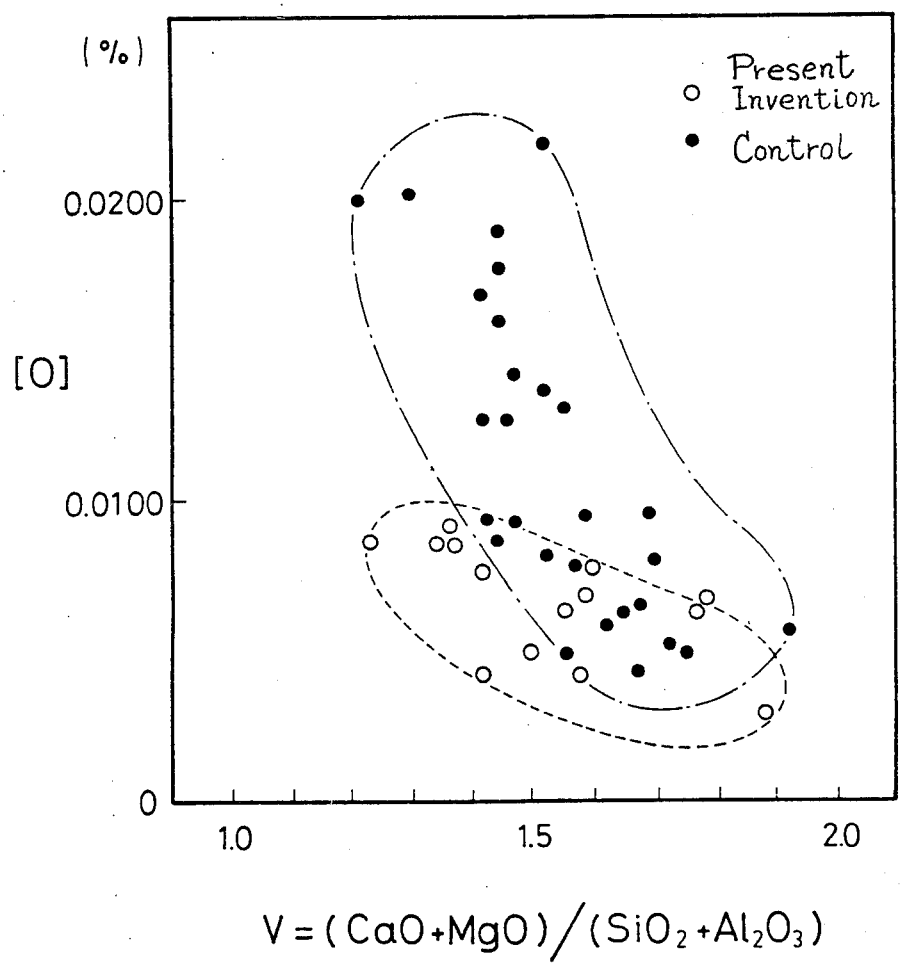
FIG. 2 is a graph showing the relation between the slag basicity and oxygen content in the molten steel, from which the merit of the present method is seen.

The results of the above experiments are shown in FIG. 2. It is clearly understood from the graph that, in the conventional refining, the oxygen content significantly increases upon decrease of slag basicity, and that, in accordance with the present invention, the oxygen content remains low even at decreased slag basicity, and therefore, it is possible to use slag of low basicity.

EXAMPLE 2

Following the chromium reduction in Example 1, further injection and blowing of argon gas (all the rates of feeding the gas are 8 $Nm^3$/min) was carried out for 6 minutes.

Analysis was made on the sample steels before and after the above refining step to determine and learn changes of Si- and Cr-contents in the molten steel. This is because reduction of $Cr_2O_3$ is made mainly by Si:

$$Cr_2O_3 + \frac{3}{2}\,Si \longrightarrow 2\,Cr + \frac{3}{2}\,SiO_2$$

and there is some relation between the contents of these elements.

The results were as follows, which prove improvement in chromium recovery. The improvement is equivalent to recovery of about 1.0 kg-Cr/ton-steel.

| | Si (%) | | Cr (%) | |
|---|---|---|---|---|
| Charge | Before the step | After the step | Before the step | After the step |
| 1 | 0.46 | 0.42 | 16.31 | 16.43 |
| 2 | 0.40 | 0.36 | 16.07 | 16.18 |
| 3 | 0.05 | 0.02 | 20.31 | 20.38 |
| 4 | 0.11 | 0.05 | 17.29 | 17.48 |

We claim:

1. A method of refining molten steel to obtain a steel of particularly low oxygen content characterized by injecting inert gas into molten steel in a refining vessel through the bottom of the vessel, and at the same time blowing inert gas from the top of the vessel so that atmosphere in the vessel may be kept almost completely inert during the refining.

2. A method of refining molten steel according to claim 1, wherein the molten steel is chromium-containing steel and blowing of the inert gas is carried out at the period of reducing chromium so as to highten chromium recovery rate.

3. A method of refining molten steel according to claim 1, wherein basicity of refining slag is so adjusted to be 1.5 or less that Mg-content in the molten steel may be lowered.

4. A method of refining molten steel according to claim 1, wherein a hood is used on the vessel to prevent invasion of air into the vessel.

* * * * *

UNITED STATES PATENT AND TRADEMARK OFFICE

CERTIFICATE OF CORRECTION

PATENT NO. : 4,445,933

DATED : May 1, 1984

INVENTOR(S) : TETSUYA SAITO ET AL

It is certified that error appears in the above-identified patent and that said Letters Patent is hereby corrected as shown below:

On the title page;

The following FOREIGN APPLICATION PRIORITY DATA should appear on the first page of the patent:

--- November 30, 1981 [JP] Japan.....192474/1981 ---.

Signed and Sealed this

*Sixth* Day of *August 1985*

[SEAL]

*Attest:*

DONALD J. QUIGG

*Attesting Officer*

*Acting Commissioner of Patents and Trademarks*